US005653015A

United States Patent [19]

Imai et al.

[11] Patent Number: 5,653,015

[45] Date of Patent: Aug. 5, 1997

[54] MULTIWIRE CABLE CONNECTION APPARATUS

[75] Inventors: Kohji Imai, Yokohama; Shiroh Yabe, Kawasaki, both of Japan

[73] Assignee: The Whitaker Corporation, Wilmington, Del.

[21] Appl. No.: 505,124

[22] Filed: Jul. 21, 1995

[30] Foreign Application Priority Data

Sep. 12, 1994 [JP] Japan ..... 6-217116

[51] Int. Cl.[6] ..... H01R 43/20

[52] U.S. Cl. ..... 29/749; 29/33 M; 29/755; 29/759; 29/760

[58] Field of Search ..... 29/33 M, 749, 29/755, 759, 760; 269/903

[56] References Cited

U.S. PATENT DOCUMENTS

| | | | |
|---|---|---|---|
| 4,034,472 | 7/1977 | Cover et al. | 29/749 |
| 4,043,017 | 8/1977 | Folk et al. | 29/759 X |
| 4,048,710 | 9/1977 | Nijman | 29/760 X |
| 4,126,935 | 11/1978 | Rhiner et al. | 29/749 X |
| 4,878,295 | 11/1989 | Muhlberger et al. | 29/749 X |

FOREIGN PATENT DOCUMENTS

| | | | |
|---|---|---|---|
| 2414571 | 10/1974 | Germany | 29/749 |
| 7-18391 | 3/1995 | Japan | 29/749 |

*Primary Examiner*—Peter Vo

[57] ABSTRACT

A multiwire cable connection apparatus reduces the mutual entangling of wires 4 and prevents damage of the insulation of the wires when pressure connected to 5 contacts 8 of a connector 6. A wire-controlling member 210, which extends along the longitudinal direction of the connector 6 is located between an end 2*a* of a multiwire cable 2 and a back surface 6*d* of the pressure contact type connector 6. Since the space wherein wires 4 cross each other by the transfer after the identification of wires 4 is restricted to the space between the multiwire cable 2 and the wire-controlling member 210, wires 4 are pressure connected to the assigned contacts 8 without crossing each other in the space between the connector 6 and the wire-controlling member 210. Therefore, the wires 4 do not engage with the connector 6 over the time from the wire identification to the transfer to the assigned contacts 8, and no damage is caused to the insulation of the wires.

10 Claims, 3 Drawing Sheets

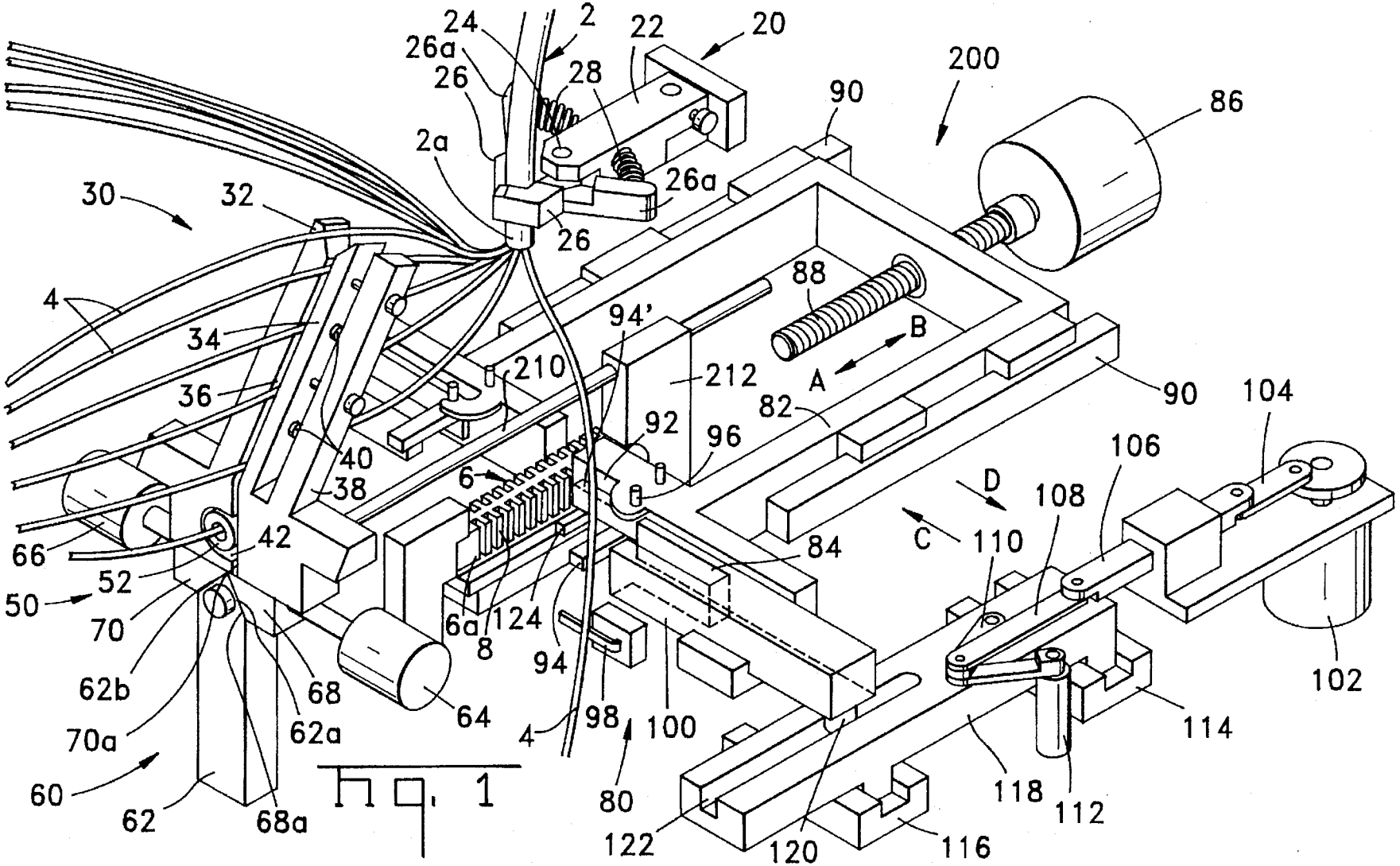
200
86
90
90
20
22
26a
28
2
24
26a
26
2a
26
88
B
A
82
212
96
92
94'
210
6
8
6a
124
94
4
98
80
100
122
120
84
C
D
110
108
106
104
102
114
112
118
116
64
1
40
38
42
68
62a
68a
62
62b
70
70a
60
52
50
66
32
34
36
30
4

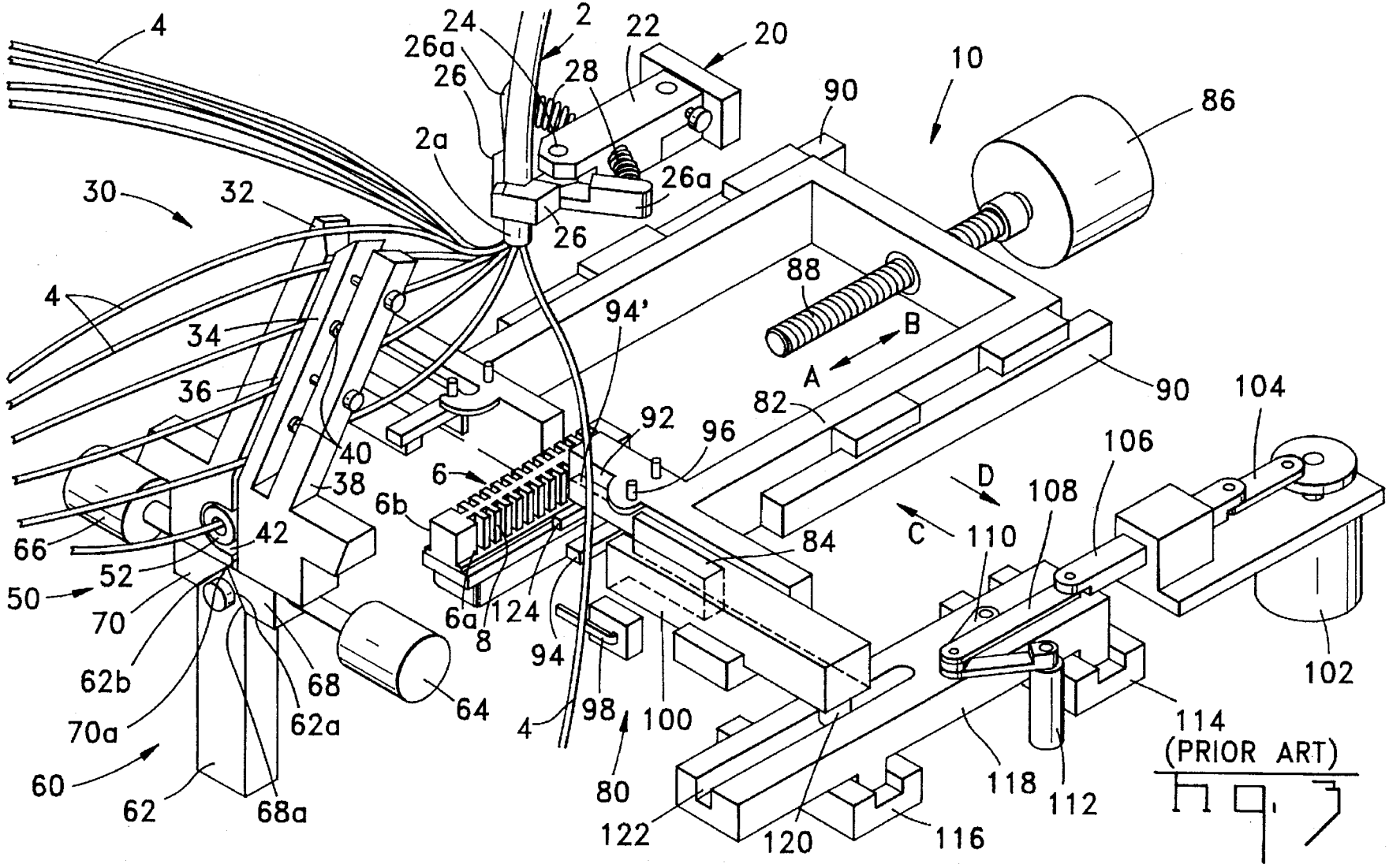
114
(PRIOR ART)
10
20
22
24
26
26a
28
2
2a
30
32
34
36
38
40
42
4
50
52
60
62
62a
62b
64
66
68
68a
70
70a
80
82
84
86
88
90
92
94
94'
96
98
100
102
104
106
108
110
112
116
118
120
122
124
6
6a
6b
8
A
B
C
D

MULTIWIRE CABLE CONNECTION APPARATUS

FIELD OF THE INVENTION

The present invention relates to a multiwire cable connection apparatus with which the wires protruding from an end of a multiwire cable are identified, and a selected wire is pressure-connected to a pressure contact aligned in two mutually facing opposite rows.

BACKGROUND OF THE INVENTION

The multiwire cable connection apparatus, with which the wires are pressure connected to pressure contacts aligned in two mutually facing opposite rows has been disclosed in Japanese UM Application NO. 5-52988 and FIG. 3 is a perspective view showing the multiwire cable connection apparatus disclosed therein.

The multiwire cable connection apparatus 10 comprises a clamp 20 which holds the end of the multiwire cable 2, a wire-aligning section 30 where plural wires 4 extending from the end of the multiwire cable 2 are aligned, a wire identification section 50 where the wire numbers of the plural wires 4 are identified, a wire distribution section 60 where the wires 4 identified are distributed, and a connection section where distributed wires 4 are pressure connected to assigned contacts 8 of the connector 6.

The clamp 20 includes a support 22 which is roughly T-shaped in plan view, and holding arms 26 which swing freely around the axis 24 at an end of the support 22. Holding arms 26 hold the multiwire cable 2 therebetween under the force of compression springs 28. By rotating the handles 26*a* of the holding arms 26 opposing to this force, the multiwire cable can be released. The other end of the support 22 is dismountably fixed to the main frame (not shown) of the apparatus. The end of the multiwire cable 2 is clamped so as to face the center of the connector 6.

The wire-aligning section includes a fixed guide 32 which is fixed to the main frame of the apparatus, a movable guide 34, and a space 36 is formed between these for aligning the wires 4. The movable guide 34 can be moved laterally with respect to a support 38, and it engages the wires 4 by compression springs 40 disposed between guide 34 and the support 38.

The wire identification section 50 includes a blade-like sensor 52 which protrudes into the space 42 which is an extension of the space 36, and a wire identification apparatus (not shown) which determines wire numbers of the wires 4 based on a signal from the sensor 52. As is well known by those in this field, the wire identification apparatus is connected to the connector (not shown) at the other end of the multiwire cable 2, and by checking the existence of conductivity between the contact of this connector and the wire 4 contacting the sensor 52, the wire number of the wire 4 is determined.

The wire distribution section 60 includes a fixed part 62 which has oblique surfaces 62*a*, 62*b* and is located in alignment with the space 42, and movable parts 68, 70 which are driven by DC solenoids 64, 66, respectively. Respective movable parts 68, 70 have oblique surfaces 68*a*, 70*a* which are complementary to the oblique surfaces 62*a*, 62*b* of the fixed part 62; and, when they are driven by the DC solenoids 64, 66, they form guide paths 72, 74 (FIG. 4) selectively with the oblique surfaces 62*a*, 62*b* of the fixed part 62. As a result of the identification of the wires 4 by the sensor 52, in the case that one of wires 4 is determined to be connected to a selected contact 8 of the connection plane 6*a* on the right hand side of the connector 6, a signal is sent from the wire identification apparatus to the DC solenoid 64, and as shown in FIG. 4, the movable part 68 moves to form a guide path 72 with the fixed part 62, thereby allowing the passage of the wire 4 therethrough. On the other hand, in the case it is to be connected to the contact 8 on the connection plane 6*b* on the left hand side of the connector 6 as a result of identification of the wire 4, the guide path 74 is formed between the movable part 70 and the fixed part 62.

The connection section 80 has a frame 82 which is movable to position assigned contacts 8 of the connector 6, and a stuffer 84 which pressure connects the wires 4 to the contacts 8. The frame 82 is driven by servomotor 86 which operates based on a signal from the wire identification apparatus by way of a threaded shaft 88. The frame 82 moves from the position at the approximate center of the connector 6 (home position) in the direction of the arrow A or B along the guide members 90 which are fixed to the main frame of the apparatus. At an end of the frame 82, held by a shaft is a guide block 94 which together with a member 92 of the frame 82 guides the wire 4. Guide block 94 is positioned as shown by a spring 96. When the wire 4 is to be pressure connected to a contact 8, guide block 94 is pushed by the pusher 100 which is formed as part of the stuffer 84, and it rotates to the position of the broken lines 94' against the action of spring 96 to guide the wire 4. Stepping motor 102 drives the stuffer 84 in the direction of the arrow C or D. The rotation of stepping motor 102 moves the sliding block 118 in the direction of arrow C or D with respect to the shaft 112 and guide rails 114, 116, which are fixed to the main frame of the apparatus, byway of links 104, 106, 108, 110. The protrusion 120 at the bottom surface of the stuffer 84 is positioned in the channel 122 of the sliding block 118, and transmits the rotation of the motor 102 to the stuffer 84 whenever the stuffer 84 is to pressure connect the wire 4 to any of the contacts 8 aligned along the connection plane 6*a* on the right side of the connector 6. Although in the foregoing the case for pressure connecting contacts 8 aligned on the connection plane 6*a* on the right side of the connector 6 to selected wires 4 has been explained, the see elements are also furnished on the left side of the apparatus in order to pressure connect contacts 8 aligned on the connection plane 6*b* on the left side to selected wires, and functions similarly.

The problem in the case when wires 4 are pressure connected to respectively assigned contacts 8 using the aforesaid multiwire cable connection apparatus is explained with reference to FIG. 5.

As shown in FIG. 5, in the case wires 4*a*, 4*b* are pressure connected to respectively assigned contacts 8, in the space 130 between the multiwire cable 2 and the connector 6, the wires 4*a* and 4*b* may be crossed and entangled; and, for example, the wire 4*b'* may be extended as shown by dash-dot lines if it is not entangled with the wire 4*a*. It may also end up with the wire 4*b* extending as shown by solid lines after entangling with the wire 4*a*. If the wire 4*b* extends as shown by the solid lines, it remains engaging with the edge 6*c* of the connector 6 from the time after the wire identification to the time when it is pressure connected to the assigned contact, and a problem arises that the insulation of the wire 4*b* may be cut. With an increasing number of wires 4*a*, 4*b*, the probability of crossing and entangling of the wires rises, and the mutually-entangled wires increase in the space 130, thereby causing more possibility of cutting of the insulation of the wires.

In view of the foregoing situation, the objective of the present invention is to present a multiwire cable connection apparatus which reduces the mutual entangling of wires and prevent the cutting of the insulation of the wires by engagement of the wires with an upper edge of the connector.

SUMMARY OF THE INVENTION

In a multiwire cable connection apparatus in which a connector having pressure contacts aligned in two rows mutually facing opposite one another, and an end of a multiwire cable from which wires protrude are clamped respectively so that each of the wires is selectively pressure connected to a respective contact, the multiwire cable connection apparatus has a wire-controlling member disposed in the space between the connector and the end of the multiwire cable which extends parallel to the row of the pressure contacts. A round stainless steel rod or beveled bar is preferred as the wire-controlling member. Also, the wire-controlling member is not limited to one piece, but two or more wire-controlling members can be used. The diameter of the wire-controlling member is preferably in the range of 80%~120% of the distance between the two rows of contacts, and more preferably its diameter is approximately equal to the distance between the two rows of contacts. Also, the position, where the wire-controlling member is placed, is preferably the position where the distance between the end of the multi-wire cable and the wire-controlling member is approximately 0.5~3.0 times the distance between a back surface of the connector and the wire-controlling member.

In the multi-wire cable connection apparatus of the present invention, since the wire-controlling member is installed which extends parallel to the rows of pressure contacts between the connector and the end of the multiwire cable, wires protruding from the end of the multiwire cable are crossed in the space between the end of the multiwire cable and the wire-controlling member. As a result, it is possible to eliminate the entangling of the wires, which engage the wire-controlling member, and which are pressure connected to the assigned pressure contacts without crossing each other in the space between the connector and the wire-controlling member. Therefore, the wires do not engage the pressure contact connector over the time from the wire identification to the transfer to the assigned contact, and the insulation of the wires is never damaged.

Incidentally, in the case that the wire-controlling member is, for example, a round stainless steel rod or a beveled bar, damage of the wires by the wire-controlling member is prevented.

Also, if the wire-controlling member is too thin, it is possible that the wires engaging with the wire-controlling member may engage with the pressure contact connector over the time from the wire identification to the transfer to the assigned contacts. On the other hand, if the wire-controlling member is too large, the wires entangling together within the space occupied by the wire-controlling member becomes large. Therefore, the wire-controlling member should preferably have a diameter in the range of 80%~120% of the distance between the two rows of the contacts, and more preferably a diameter approximately equal to the distance between the two rows of contacts. Also, if the wire-controlling member is placed too close to the connector, the wires engaging the wire-controlling member may possibly engage with the pressure contact connector over the time from the wire identification to the transfer to the assigned contacts. On the other hand, if the wire-controlling member is placed too close to the end of the multiwire cable, the space between the wire-controlling member and the multiwire cable becomes too narrow, and the wires may be entangled in this space causing difficulty in moving the wires. Therefore, the position to place the wire-controlling member is preferably the position where the distance between the end of the multiwire cable and the wire-controlling member is approximately 0.5~3.0 times the distance between the pressure contact connector and the wire-controlling member.

BRIEF DESCRIPTION OF THE DRAWINGS

An embodiment of the invention will now be described by way of example with reference to the accompanying drawings in which:

FIG. 1 is a perspective view showing a multiwire cable connection apparatus of the present invention.

FIG. 2 is a view showing the shape and position of the wire-controlling member of the multiwire cable connection apparatus shown in FIG. 1.

FIG. 3 is a perspective view showing a conventional multiwire cable connection apparatus.

DETAILED DESCRIPTION OF THE INVENTION

Figure 4:
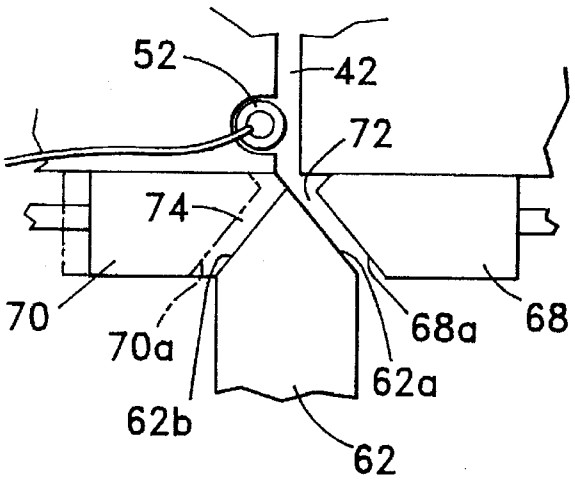
(PRIOR ART) FIG. 4
FIG. 4 is a front view showing the wire distribution section of the multiwire cable connection apparatus in FIG. 3.
Figure 5:
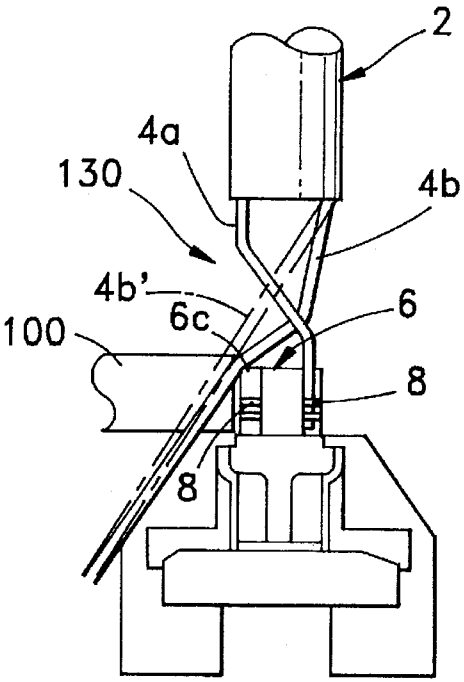
(PRIOR ART) FIG. 5
FIG. 5 is a view showing the mutual crossing and entangling of the wires in the space between the multiwire cable and the connector when wires are pressure connected to the assigned contacts.
Figure 7:
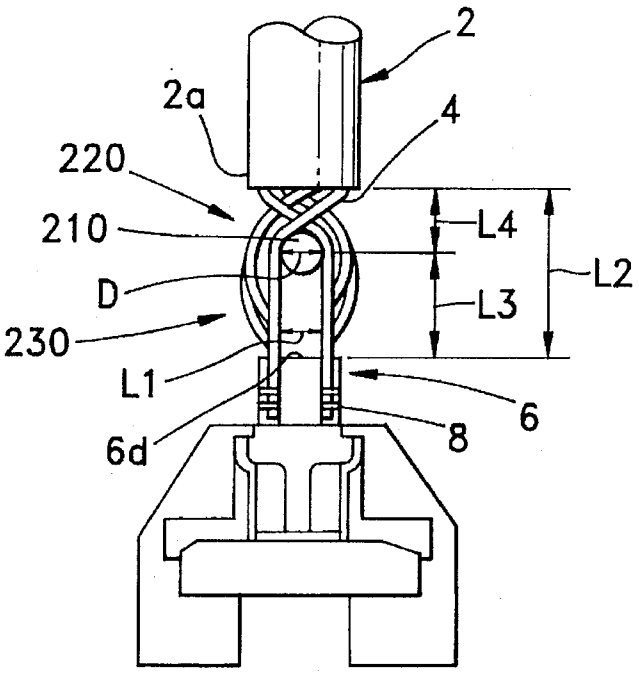

The important feature of the multiwire cable connection apparatus 200 shown in FIG. 1 is that a wire-controlling member 210 made of a round rod extending parallel to the rows of pressure contacts 8 is installed between the back surface 6*d* of the pressure contact type connector 6 and an end 2*a* of the multiwire cable 2. This wire-controlling member is removably supported by the fixed part 62 and also removably supported by the support 212 which is fixed to the frame 82; and, before wires 4 are pressure connected to the contacts 8 of connector 6, the wire-controlling member 210 is inserted and supported by the fixed part 62 and the support 212. After completion of the pressure connections, the wire-controlling member 210 is removed from the fixed part 62 and the support 212.

The procedure of pressure connecting wires 4 to the connector 6 using the multiwire cable connection apparatus 200, in which the wire-controlling member 210 is installed, is explained with reference to FIG. 1.

Before the connection operation, the clamp 20, with which an end of the multiwire cable is clamped, is mounted on the main frame of the apparatus, and many wires are held between the fixed guide 32 and the movable guide 34 of the wire-aligning section 30, and aligned along the space 36. Also, the wire-controlling member 210 is positioned between the fixed part 62 and the support 212 and supported thereby. After completion of this preparation, the wire 4 at the bottom of the aligned wires 4 is grasped and moved along the spaces 36, 42 downward. Since the wires 4 are aligned along the space 36, there is no entangling of the wires 4. The wire 4 in passing along the space 42, the sensor 52 makes contact with the conductor through the insulation of the wire 4, and the wire number of the wire 4 is determined by the wire identification apparatus which is not shown. Based on the identification signal from the wire identification apparatus, only one of the movable parts 68 or 70 moves to form a guide path 72 or 74, (refer to FIG. 4) on one side. The operator does not pay attention to a display or anything, and simply moves the wire 4 along this guide path 72 or 74 on one side, and applying tension to the extent the wire 4 does not have any slack between the multiwire cable 2 and the connector 6, the wire 4 pushes a microswitch 98 on either the right side or left side. When the microswitch is pushed with wires 4 in their order, wires 4 extending from the end of the multiwire cable 2 cross each other in the space 220 (refer to FIG. 2) between the end 2*a* of the multiwire cable 2 and the wire-controlling member 210. As a result, as shown in FIG. 2, entangling of the wires is eliminated and wires 4 engaging the wire-controlling member 210 are pressure connected to assigned contacts 8 without crossing each other in the space between the back surface 6*d* of the connector 6 and the wire-controlling member 210. Consequently, the wires 4 do not engage with the pressure contact connector 6 over the time from the wire identification to the transfer to the assigned contacts 8, and no damage occurs to the insulation of the wires 4.

When the wire 4 pushes the microswitch 98 on either the right side or left side, the signal from the microswitch causes the motor 102 to rotate, for example, 90°, and drives the pusher 100 along with the stuffer 84 in the direction of the arrow C. This rotates the guide block 94 and leads the wire 4 between the member 92 and the guide block 94. Then, based on the result of the wire number determination, the motor 86 rotates and moves the frame 82 in the direction of the arrow A or B and positions the assigned contact 8. Subsequently, the motor 102 rotates further, for example, 270°, and the stuffer 84 pressure connects the wire 4 to the assigned contact 8, and at the same time, the wire 4 is cut by the edge of the stuffer 84 and the blade 124. After the wire 4 is pressure connected, the stuffer 84 moves in the direction of arrow D and returns to the initial position and readies itself for the next connection operation. The same procedure is repeated for each of the wires 4, as they are connected to the assigned contacts.

Again referring to FIG. 2, the shape and position of the wire-controlling member are explained.

The aforesaid example is the case wherein the number of wires is 50, the distance L1 between the rows of contacts 8 to which the wires are pressure connected is 3 mm, and the diameter D of the wire-controlling member 210 is 3 mm. Also, the distance L2 between the multiwire cable 2 and the connector 6 is 12.4 mm, and the distance L3 between the center of the wire-controlling member 210 and the connector 6 is 6.5 ram. Therefore, the distance L3 is approximately one times the distance L4 between the multiwire cable 2 and the center of the wire-controlling member 210.

Incidentally, in case the kind and also the number of the wires 4 are different, the distance L2 is different. For example, in case the number of the wires 4 is 14, L2 is preferably 10 mm, and in case it is 120, L2 is preferably 25 mm.

In accordance with the foregoing, the multiwire cable connection apparatus of the present invention has been explained, but the present invention is not limited to the above described example, and it is possible to modify or change it in various ways, as for example, the wire-controlling member 210 can be two or more.

As explained above, since the wire-controlling member is installed in the multiwire cable connection apparatus of the present invention, wires protruding from an end of a multiwire cable cross each other in the space between the end of the multiwire cable and the wire-controlling member, and the mutual entangling of the wires is eliminated. Also, the wires engaging with the wire-controlling member are pressure connected to assigned contacts of a connector without crossing each other in the space between the back surface of the pressure contact connector and the wire-controlling member. Therefore, the wires do not engage with the pressure contact connector over the time from the wire identification to the transfer to the assigned contacts, and no damage is caused to the insulation of the wires.

We claim:

1. A multi-wire cable connection apparatus, said apparatus comprising:

(a) a connector-holding device, said connector-holding device is operative to hold an electrical connector therein;

(b) a cable clamp, said cable clamp is operative to clamp an end of a multi-wire cable with wires thereof extending from the cable end;

(c) a wire distribution section, said wire distribution section comprises movable surfaces which define a wire receiving channel, said movable surfaces are movable by a control mechanism, and upon operation of said control mechanism said movable surfaces are thereby operative to guide said wires in selected paths;

(d) a wire-controlling section, said wire controlling section is located between said wire distribution section and said connector-holding device; and (e) said control mechanism is operative to selectively place wires on opposing sides of the wire-controlling section, whereby said wire-controlling section guides the wires toward said connector-holding device.

2. The multi-wire cable connection apparatus of claim 1, wherein the wire-controlling section is connected to said wire distribution section.

3. The multi-wire cable connection apparatus of claim 1, wherein the wire-controlling section comprises an elongated member along which the wires are guided to the connector-holding device.

4. The multi-wire cable connection apparatus of claim 1, wherein the wire-controlling section spans a distance defined between said wire distribution section and said connector-holding device.

5. The multi-wire cable connection apparatus of claim 1, wherein the wire-controlling section comprises a rod.

6. A multi-wire cable connection apparatus, said apparatus comprising:

(a) a connector-holding device, said connector-holding device is operative to hold an electrical connector therein;

(b) a wire distribution section, said wire distribution section comprises-movable surfaces which define a wire receiving channel, said movable surfaces are movable by a control mechanism, and upon operation of said control mechanism said movable surfaces are thereby operative to guide said wires in selected paths;

(c) a wire-controlling section, said wire controlling section is located between said wire distribution section and said connector-holding device; and (d) said control mechanism is operative to selectively place wires on opposing sides of the wire-controlling section, whereby said wire-controlling section guides the wires toward said connector-holding device.

7. The multi-wire cable connection apparatus of claim 6, wherein the wire-controlling section is connected to said wire distribution section.

8. The multi-wire cable connection apparatus of claim 6, wherein the wire-controlling section comprises an elongated member along which the wires are guided to the connector-holding device.

9. The multi-wire cable connection apparatus of claim 6, wherein the wire-controlling section spans a distance defined between said wire distribution section and said connector-holding device.

10. The multi-wire cable connection apparatus of claim 6, wherein the wire-controlling section comprises a rod.

* * * * *